US006679278B2

(12) United States Patent
Lemoine et al.

(10) Patent No.: US 6,679,278 B2
(45) Date of Patent: Jan. 20, 2004

(54) CONTROLLABLE VALVE PARTICULARLY FOR DELIVERING A PULSED FLOW OF FLUID

(75) Inventors: Olivier Lemoine, Parthenay cedex (FR); Luc Jarry, Parthenay cedex (FR); Dominique Gresser, Parthenay cedex (FR); Christian Boutet, Parthenay cedex (FR)

(73) Assignee: Safmatic, Parthenay Cedex (FR)

( * ) Notice: Subject to any disclaimer, the term of this patent is extended or adjusted under 35 U.S.C. 154(b) by 320 days.

(21) Appl. No.: 09/848,338

(22) Filed: May 4, 2001

(65) Prior Publication Data

US 2001/0044083 A1 Nov. 22, 2001

(30) Foreign Application Priority Data

May 17, 2000 (FR) ..... 00 06311

(51) Int. Cl.[7] ..... F23C 11/04
(52) U.S. Cl. ..... 137/12; 251/129.05; 431/1
(58) Field of Search ..... 431/1; 251/129.15, 251/129.05; 137/12

(56) References Cited

U.S. PATENT DOCUMENTS 3,043,366 A 7/1962 Wentworth
4,373,697 A * 2/1983 Phelps ..... 251/129.05
4,766,921 A * 8/1988 Williams ..... 137/1
5,388,984 A * 2/1995 Meslif ..... 431/1

FOREIGN PATENT DOCUMENTS

| | | |
|---|---|---|
| DE | 33 37 259 | 10/1983 |
| EP | 0 473 451 | 8/1991 |
| JP | 57 157878 | 3/1981 |
| JP | 57 010020 | 1/1982 |
| JP | 61 228179 | 10/1986 |

* cited by examiner

*Primary Examiner*—A. Michael Chambers
(74) *Attorney, Agent, or Firm*—Burns, Doane, Swecker & Mathis, L.L.P.

(57) ABSTRACT

The invention relates to a controllable valve, particularly for delivering a pulsed flow of fluid.

It comprises a valve body (10); a valve seat (12) dividing the inside of the body into an inlet chamber (14) and an outlet chamber (16); a valve shutter element (22) capable of moving; an actuator (24) comprising a stationary control part (26) for receiving control signals and a moving part (28); first rigid means of connection (30) for connecting the said moving part of the actuator (28) to the said shutter element (22); a mechanical stop (40'); a member (38) that can be compressed under the effect of a force applied to it, comprising a first end secured to the said mechanical stop; and second rigid means (36') for dynamically connecting one of the faces of the said shutter element (**22*b*) to the second end of the said compressible member (38**).

43 Claims, 3 Drawing Sheets

S
T
T1
T2
t

Q
F1
F2
P
C
t

X'
44
46
18
30
60
14
56b
56
64a
54
38
50
64
56a
52
20
62
16
42
40'
X 44
46
18
30
60
14
56b
56
64a
54
50
52
20
40'

CONTROLLABLE VALVE PARTICULARLY FOR DELIVERING A PULSED FLOW OF FLUID

BACKGROUND OF THE INVENTION

1. Field of the Invention

The subject of the present invention is a valve and, in particular, a valve that can be controlled to deliver a pulsed flow of gas at its outlet.

The expression "pulsed flow" is to be understood as meaning that this flow alternates between a high level and a low level during predetermined periods of time resulting from the application of a control signal, generally in the form of square waves 2. Description of the Related Art Valves which can be controlled to make them supply a pulsed flow at their outlet may find numerous applications, particularly in installations for the pulsed supply to burners of the oxyfuel type. An installation such as this is described in particular in document EP 524 880.

As mentioned in that document, it has in fact been demonstrated that if a burner were to be supplied with a pulsed flow, at least as regards either its fuel or its oxygen supply, it would be possible to obtain a very significant reduction in the nitrogen oxide content of the residual flue gases from the burner. A valve may be fitted to the fuel, particularly natural gas, supply or to the pipe supplying the oxygen supply, typically oxygen, or to both pipes, depending on the installation. As is also described in the aforementioned document, the pulsation frequency is preferably below 1 Hz. Furthermore, in order to obtain a significant effect of reducing the oxides of nitrogen produced, it is necessary for the flow rate or pressure of pulsed gas to have a shape as close as possible to the square waves corresponding to the signals used to control the valve or valves used.

Such valves can also be used for supplying burners with air by way of a source of oxygen.

Depicted in the appended FIGS. 1*a* and 1*b* is one example of a control signal S for controlling the electrically operated valve as a function of time, and the curve of gas pressure P delivered at the outlet of the valve receiving this control signal. FIG. 1*a* depicts the control signal S which has a first high level during periods $T_1$, known as the open level, and a low level during periods $T_2$, known as the closed level. The periods $T_1$ and $T_2$ are usually equal. FIG. 1*b* depicts the pressure of the gas at the outlet of the valve in a temporal relationship with the control signal S. The pressure level corresponding to the closed control signal has been labelled C and the pressure difference between the open and closed signals has been labelled Q. It can be seen from this figure that during the periods corresponding to the application of the open signal, the pressure is not strictly in the shape of a square wave but has an inclined rising edge F1, a falling edge F2 which is also inclined and, while the open signal is applied, the pressure is not constant. As has been mentioned, it is desirable for the shape of the pressure waves to be as rectangular as possible.

Another problem in supplying a pulsed flow lies in the fact that these valves are used and controlled a great many times during the period that the burner is operating. It is therefore necessary that the valve should not only be as near as possible to a perfect square wave, but also for it to have very good repeatability in terms of the opening pressure and closure pressure of the fluid delivered over time.

In an attempt at solving this problem, a valve described in particular in American Patent U.S. Pat. No. 5,222,713 has already been proposed. The flow control element of this valve consists of a part whose periphery is deformable, thus making it possible, depending on the stress applied to it, to allow the fluid to pass or to interrupt its passage. The actuator allowing the pulsed deformation of this component is, for example, a piezoresistive element controlled electrically according to the desired pulsation frequency. However, it has become apparent that the deformation of the element constituting the shutter element of the valve alters with use and is not very repeatable from one valve to another, particularly as far as the flow rates corresponding respectively to the open and to the closed states are concerned.

SUMMARY OF THE INVENTION

One object of the present invention is to provide a controllable valve, particularly for delivering a pulsed flow, which has an outlet curve in terms of flow or in terms of pressure which is approximately in the form of rectangular square waves and which, moreover, has satisfactory repeatability, particularly as far as the flow rate or pressure supplied in the open state and in the closed state are concerned.

In order to achieve this objective according to the invention, the controllable valve particularly for delivering a pulsed flow of fluid, comprises:

- a valve body;
- a valve seat dividing the inside of the valve body into a fluid inlet chamber and an outlet chamber;
- a valve shutter element capable of moving in one direction of travel to collaborate with the valve seat;
- an actuator comprising a stationary control part for receiving control signals and a moving part, the said stationary part applying to the moving part a force which corresponds to the control signal;
- first rigid means of connection extending in the direction of travel so as to connect the said moving part of the actuator to the said valve shutter element;
- a mechanical stop;
- a member that can be compressed under the effect of a force applied to it, comprising a first end secured to the said mechanical stop; and
- second rigid means for dynamically connecting one of the faces of the said valve shutter element to the second end of the said compressible member.

It will be understood that, on the one hand, since the open and closed flow rates respectively are defined by a rigid seat and by a rigid valve shutter element, these flow rates are intrinsically perfectly stable over time. It will also be understood that, when the control signal is no longer applied to the stationary part of the actuator, the shutter element moves in one direction or the other depending on the embodiment in question, not only under the effect of the cancellation of the corresponding force but also under the effect of the release of the compressible member which was previously compressed. It will be understood that by using a compressible member which has properties which are very stable over time, it will be possible to obtain very uniform valve operation. Furthermore, it is understood that the rising or falling edges will be improved by comparison with the known solutions, because of the action of the compressible member According to a first embodiment, the second rigid means of connection connect to the second end of the compressible member that face of the valve shutter element which faces towards the valve seat.

According to a second embodiment, the second rigid means of connection connect to the second end of the compressible member that face of the valve shutter element which does not face towards the valve seat, the said second rigid means including the said first rigid means of connection.

It will be understood that, according to the first embodiment, in the absence of a control signal, the valve shutter element returns spontaneously to its open position under the effect of the compressible member. By contrast, in the second embodiment, the valve shutter element returns to its closed position under the effect of the release of the compressible member. As will be indicated later on, the term "closed position" must not be taken as necessarily meaning that the shutter element is pressed against its seat in such a way that the flow rate is effectively zero, but as meaning a position of the shutter element such that the flow rate supplied is low by comparison with the flow rate supplied in the open position.

As a preference, the compressible member consists of a part made of elastomeric material chosen for the consistency of its compressibility characteristics, this part having two parallel faces which are interposed directly or indirectly between the mechanical stop and the shutter element.

The invention also relates to a method of combustion in which a flow of oxidizing agent and a flow of fuel are injected into a furnace, in which the oxidizing agent and the fuel react with one another to produce a flame capable of heating a charge. According to the invention, this method is characterized in that the flow of oxidizing agent and/or the flow of fuel is or are injected in a pulsed manner using a pulsing valve as described in the text of this specification.

As a preference, at least one pulsing valve is used to inject fuel and at least one pulsing valve is used to inject oxidizing agent, the pulsations being identical (or different) in terms of duration but in phase opposition. According to another alternative form of the invention, the pulsations have the same duration (or different durations) but are in phase.

According to another alternative form of the invention, in which there are at least two separate injections of oxidizing agent, using identical or different oxidizing agents chosen from oxygen, substantially pure oxygen, (and particularly oxygen delivered by an apparatus for separating the gases in the air, operating by adsorption, also known as VSA or "vacuum swing adsorption", particularly containing at least 88% of oxygen, about 2 to 5% of argon, and any remainder being 0 to 10% of nitrogen) oxygen-enriched air, air or oxygen-impoverished air, at least one of the two injections being carried out using a pulsing valve. In general, the invention also relates to the use of a pulsing valve as defined in this specification for pulsing an oxidizing gas and/or fuel.

BRIEF DESCRIPTION OF THE FIGURES OF THE DRAWING

Other features and advantages of the invention will become better apparent from reading the description which follows of a number of embodiments of the invention which are given by way of non-limiting example. The description makes reference to the appended drawings in which.

DETAILED DESCRIPTION OF THE PREFERRED EMBODIMENTS

Figure 2A:
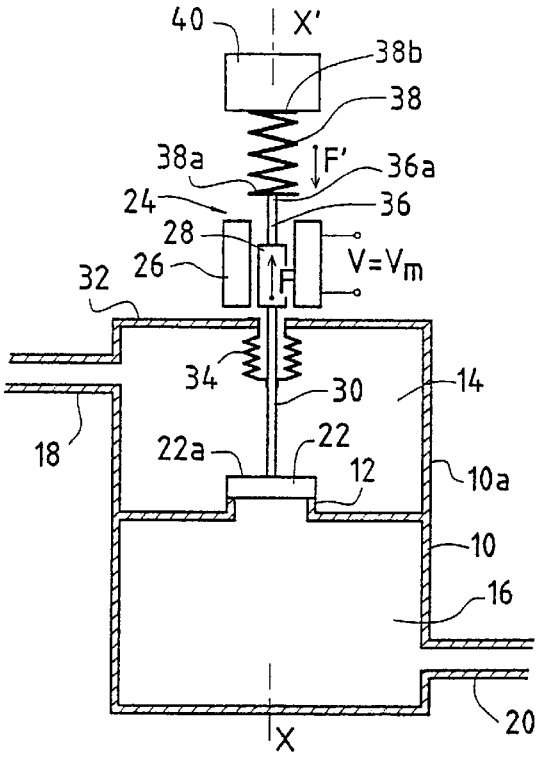
FIGS. 2*a* and 2*b* show, in diagrammatic form, one first embodiment of the valve in the closed position and in the open position, respectively.
Figure 2B:
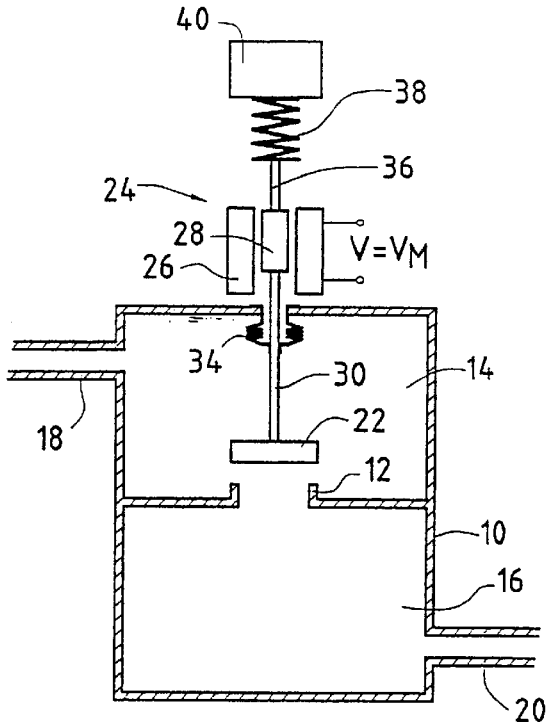

A first embodiment of the valve will be described referring first of all to FIGS. 2*a* and 2*b*. This valve consists of a valve body 10 comprising a seat 12 which divides the inside of the valve body into an inlet chamber 14 and an outlet chamber 16 for the fluid. The chambers 14 and 16 are equipped respectively with an inlet pipe 18 and with an outlet pipe 20 which open into the lateral wall 10*a* of the valve body. The valve also comprises a valve shutter element 22 capable of moving along the axis X–X' of the valve body. This shutter element is of course intended to collaborate with the seat 12 to define the flow rate through the valve according to the position of the shutter element. The shutter element 22 is connected by its face 22*a* away from the seat 12 to an actuator 24. The actuator 24 consists of a stationary control part 26 consisting, for example, of an induction coil powered with a control voltage and of a moving part 28 which, for example, is an electromagnetic core plunger. The face 22*a* of the shutter element is connected to the core plunger 28 by a rigid rod 30 which passes through the end wall 32 of the valve body. As a preference, this penetration is equipped with a sealing boot 34. The core plunger 28 is extended by a second rigid rod 36, the end 36*a* of which collaborates with the first end 38*a* of a compressible member 38. The second end 38*b* of the compressible member 38 is pressed against a mechanical stop 40.

It will be understood that the position of the valve shutter element 22 with respect to the seat 12 and therefore the through flow rate depend on the combination of the axial force produced by the coil 26, applied to the core plunger 28 and referenced F, and of the compression force F' of the compressible member.

It will also be understood that the force F applied to the core plunger 28 of course depends on the control voltage V applied to the coil 26. For the position of the shutter element corresponding to the minimum flow rate which, as has already been explained, is not necessarily zero, a voltage $V_m$ is applied such that the combination of the forces F and F' produces the desired position of the shutter element. As a preference, the control voltage $V_m$ is zero. By contrast, as FIG. 2*b* shows, when the control voltage $V_M$ corresponding to the open position is applied, the resultant of the forces F and F' is such that the shutter element 22 is moved away from its seat to produce the maximum flow rate.

It will also be understood that, in this embodiment, the closure of the valve, or more specifically the arrival of the shutter element in its minimum-flow-rate position, results not only from the change in control voltage corresponding to the control signal S, but also from the action of the compressible member 38. Very quick valve closure is thus achieved. By contrast, the opening of the valve is simply the result of the action of the force F applied to the core plunger to compress the compressible member 38.

Figure 3A:
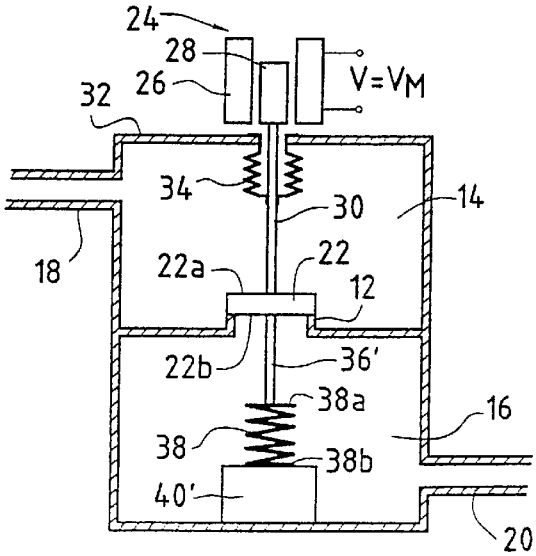
FIGS. 3*a* and 3*b* show a skeleton diagram of a second embodiment of the valve which is depicted in the closed position and in the open position, respectively.
Figure 3B:
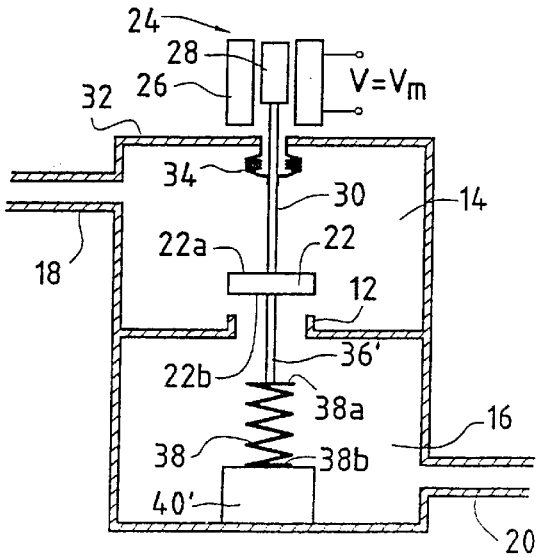

In the embodiment depicted in FIGS. 3*a* and 3*b*, we see again the valve body 10 with its upper chamber 14 and lower chamber 16, its valve seat 12 and its moving shutter element 22. The face 22*a* of the shutter element away from the seat 12 is still connected by a rigid rod 30 to the moving core plunger 28 of the actuator 24. The other face 22*b* of the shutter element is connected to the first end 38*a* of the compressible member 38 by a rigid rod 36', the other end 38*b* of the compressible member 38 being pressed against the mechanical stop 40'.

It will be understood that, in this second embodiment, when the control voltage is equal to $V_M$, the shutter element 22 is brought closer to its seat 12 and the compressible member 38 is compressed. By contrast, when the control voltage $V_m$ is applied, the force applied to the core plunger 28 is smaller and the shutter element 22 moves away from the seat 12, allowing the compressible member 38 to expand. It will be understood that, in this embodiment, closure is obtained simply by applying the electromagnetic force of the actuator, which also compresses the compressible member 38. By contrast, valve opening is associated both with the change in control voltage and with the return of the compressible member 38 to its state of rest.

The so-called open and closed positions still result from the antagonistic effect of the force applied to the core plunger of the actuator and of the force developed by the compressible member. By appropriately adjusting the force applied to the core plunger, that is to say by appropriately adjusting the control voltage applied to the coil 26, different open and closed positions which will be perfectly repeatable can thus be defined. As will be explained later on, it is also possible to envisage for the mechanical stop 40 or 40' to be adjustable.

In FIGS. 2 and 3, the compressible member 38 consists of a coil spring, the axis of compression of which coincides with the axis of travel of the shutter element. It is also possible, as will be explained in greater detail later on, to use a part made of compressible material which has a very stable and very repeatable curve of compression as a function of applied force. It will also be understood that the choice between the two embodiments described previously will be made on the basis of whether it is more appropriate to have a high valve closure speed or a high valve opening speed.

It should also be added that the actuator may be a double-acting actuator, that is to say that the two control voltages cause the core plunger 28 to move in opposite directions with respect to the position of rest corresponding to a zero control voltage.

Figure 4A:
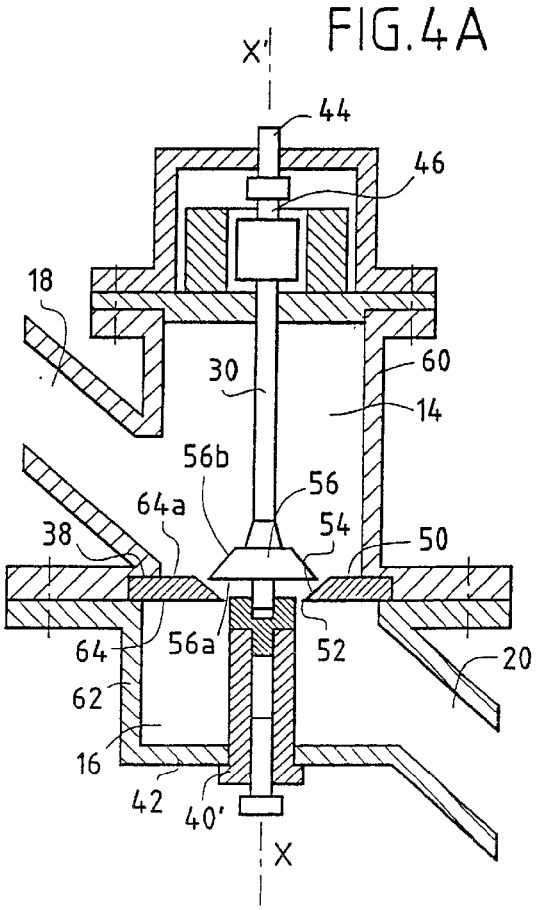
FIGS. 4*a* and 4*b* show a preferred embodiment of the valve in greater detail in the open position and in the closed position, respectively, and corresponding to the principle of the valves shown in FIGS. 3*a* and 3*b.

One preferred embodiment of the second type of valve depicted in FIGS. 3*a* and 3*b* will now be described in greater detail with reference to FIGS. 4*a* and 4*b*. That figure again shows the inlet chamber 14, the outlet chamber 16 and the respective inlet pipe 18 and outlet pipe 20, occupying lateral positions with respect to the longitudinal axis X–X' of the valve body. The valve seat consists of a plate 50 pierced with an orifice 52, the lateral wall 54 of which has the shape of a cone frustum of axis X–X'. As a preference, the half-angle a of this cone frustum, the vertex of which points towards the outlet chamber 16, is at least equal to 45 degrees. Likewise, FIG. 4*a* depicts a preferred embodiment of the shutter element of this valve, which carries the reference 56. The face 56*a* of the shutter element, facing towards the seat, is approximately flat, whereas its other face 56*b* also has the overall shape of a cone frustum, the vertex of which cone would be in the inlet chamber 14. The half-angle b of the cone frustum forming the face 56*b* of the shutter element is of the order of 60 degrees.

The particular shape given to the seat 52 and to the shutter element 56 makes it possible, on the one hand, to stabilize the flow around the shutter element and, on the other hand, to have a faster change in passage cross section for the fluid between the two chambers when the shutter element 56 is moved away from this seat. These arrangements encourage straighter and more upright pulsed pressure waves rising and falling edges.

Figure 4B:
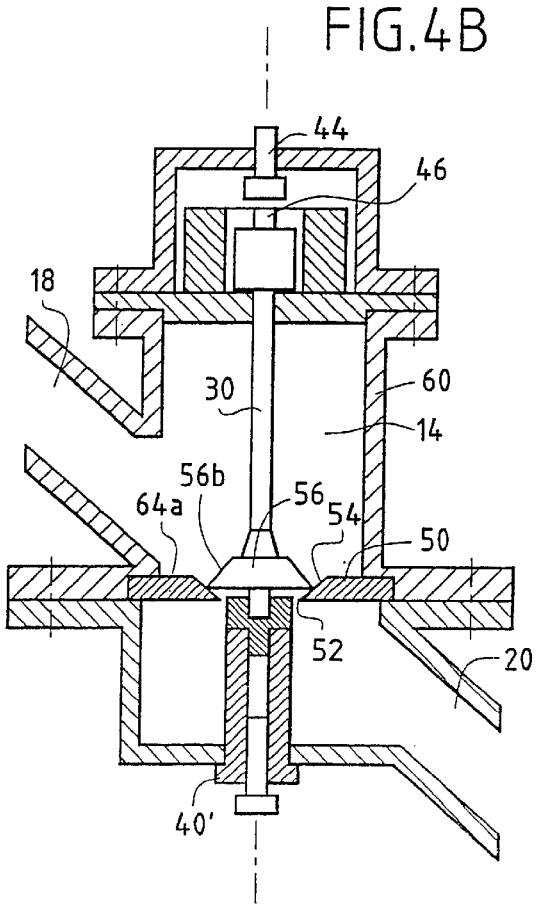

As FIGS. 4*a* and 4*b* show, the valve body 10 is preferably made in two parts, an upper part 60 which corresponds to the inlet chamber 14, and a lower part 62 corresponding to the outlet chamber 16. The seat 12 is machined in a plate 64, the periphery 64*a* of which is trapped between the upper part 60 and lower part 62 of the valve body, these two parts being assembled by any appropriate means. It is thus possible for the two parts forming the valve body to be taken apart to extract the plate 64 and replace it with another one in which a seat of different dimensions has been machined. In addition, it is envisaged for the shutter element 22 to be detached from the rod 30 such that it can be disassembled. It is then possible for different seat/shutter element assemblies to be fitted in the valve to correspond to different flow rates.

In this embodiment, the position of the mechanical stop 40' supporting the compressible member 38 is adjustable with respect to the end 42 of the valve body. As a preference, the valve comprises a second axial mechanical stop 44, also adjustable, which can collaborate with a peg 46 which is an extension of the core plunger 28. This second mechanical stop defines the valve wide-open position. By altering the value of the opening voltage $V_m$, it is possible to define other open positions of the valve, which are of course not as wide open as this wide-open position.

Elastomeric springs of the EFFBE type produced by CEF based on chloroprene or polyurethane may be used to make the compressible member. These "springs" have a compression rate of 30 to 40%. They consist of a single ring or of two superposed rings. As they display residual deformation, it is desirable to envisage a fixture that allows a preload suited to this residual deformation.

Figure 1A:
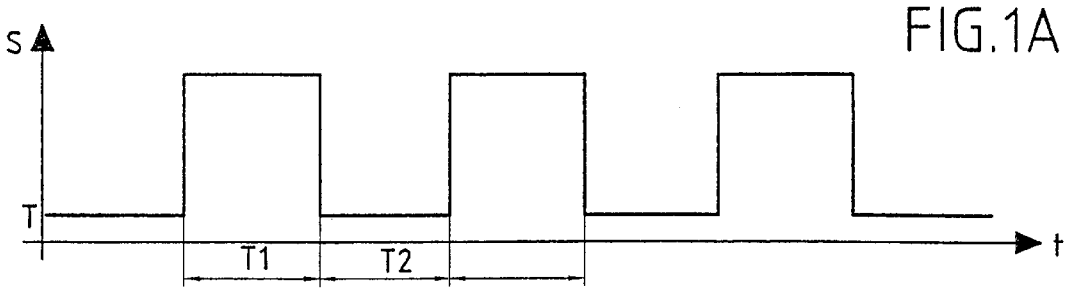
FIGS. 1*a* and 1*b,* already described, show the control signal S and the pressure of the fluid delivered by the valve, respectively.
Figure 1B:
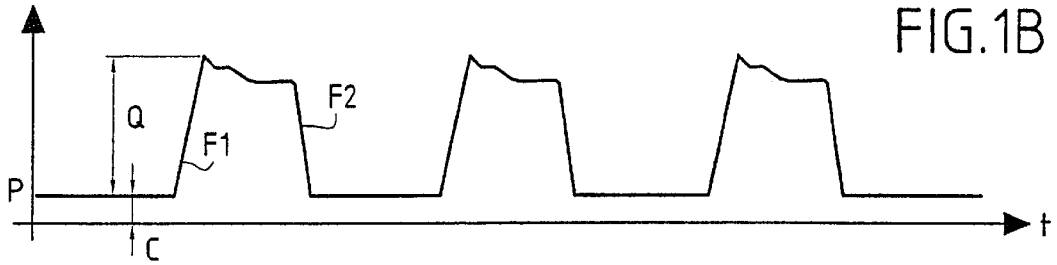
Figure 5A:
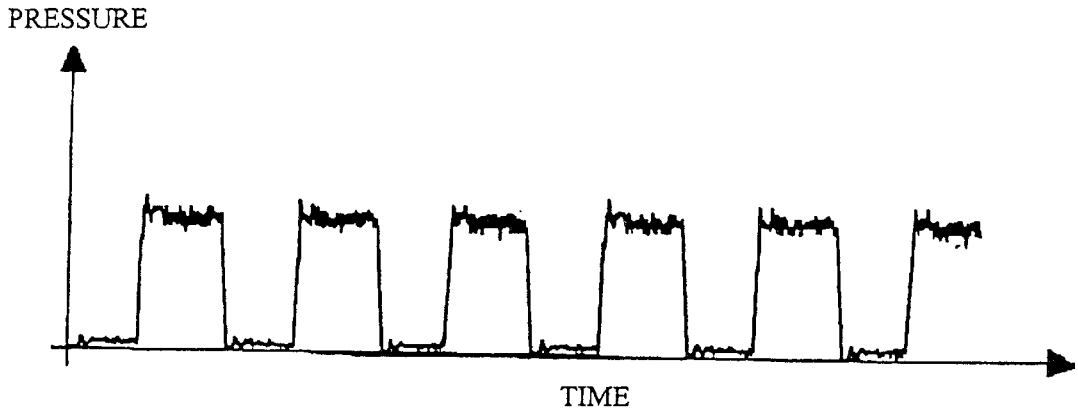
* and FIGS. 5*a* and 5*b* show curves expressing the pressure of the fluid at the outlet of the valve depicted in FIGS. 4*a* and 4*b.*
Figure 5B:
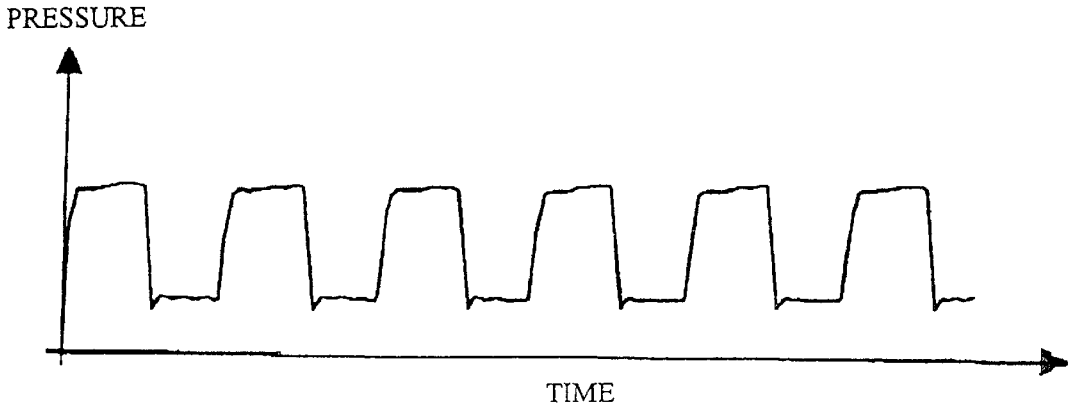

FIGS. 5*a* and 5*b* show the pulsed flows obtained with the electrically operated valve described in conjunction with FIGS. 4*a* and 4*b*. In these figures, the time is shown on the abscissa axis and the ordinate axis shows a parameter P representing the pressure at the outlet of the valve as measured with a pressure sensor. In the example under consideration, the frequency is 0.5 hertz. FIG. 5*a* shows a pressure signal with almost vertical rising and falling edges. In the case of FIG. 5*b*, the square waves have rising and falling edges which are less vertical while remaining acceptable, but have very good consistency of the "high" and "low" levels. The difference between these curves is the result of the different amount of preload applied to the elastomeric part. In the known solutions, the control signal is of the "square wave" type, as depicted in FIG. 1*a*.

According to an alternative implementation of the invention, it is possible to alter the shape of the electric control signal so as to further improve the rising and falling edges of the pressure wave at the valve outlet. In particular, it may be envisaged for the voltage, for a brief period of time during valve opening, to reach a value higher than the "open" state control value, as this further "accelerates" valve opening. Likewise, during valve closure, it may be envisaged for the control voltage, for a brief period of time, to drop to a value below the "closed" state control voltage value, as this accelerates valve closure.

What is claimed is:

1. Controllable valve suitable for delivering a pulsed flow of fluid, comprising:

a valve body;

a valve seat dividing the inside of the valve body into a fluid inlet chamber and an outlet chamber;

a valve shutter element capable of moving in one direction of travel to collaborate with the valve seat;

an actuator comprising a stationary control part for receiving control signals and a moving part, the stationary part applying to the moving part a force which corresponds to the control signal;

first rigid means of connection extending in the direction of travel so as to connect the moving part of the actuator to the valve shutter element;

a mechanical stop;

a member that can be compressed under the effect of a force applied to it, comprising a first end secured to the mechanical stop; and second rigid means for dynamically connecting one of the faces of the valve shutter element to the second end of the compressible member, or for dynamically connecting the moving part of the actuator to the second end of the compressible member.

2. Valve according to claim 1, wherein the second rigid means of connection connect the second end of the compressible member to the face of the valve shutter element which faces towards the valve seat.

3. Valve according to claim 2, wherein the stop is adjustable in terms of position with respect to the valve body in the direction of travel.

4. Valve according to claim 2, wherein it further comprises an addditional stop which is adjustable in terms of position with respect to the valve body in the direction of travel so as to limit the travel of the valve shutter element under the effect of the decompression of the compressible member.

5. Valve according to claim 2, wherein the compressible member comprises a part made of an elastomeric material with two parallel faces orthogonal to the direction of travel.

6. Valve according to claim 2, wherein the compressible member comprises a mechanical spring, the compression axis of which lies in the direction of compression.

7. Valve according to claim 2, wherein the valve seat comprises a frustoconical surface widening towards the inlet chamber, and the cone angle of which is at least equal to 90 degrees.

8. Valve according to claim 2, wherein the valve shutter element has a first face facing towards the valve seat which is substantially flat and a second face away from the valve seat which has the shape of a cone frustum widening towards the outlet chamber.

9. Valve according to claim 2, wherein the valve body comprises two separate parts comprising the inlet chamber and the outlet chamber respectively, and in that the seat is machined in a plate, the periphery of which is secured to the two parts that form the valve body and in that the shutter element is secured to the first rigid connection means by removable means.

10. Method of combustion in which a flow of oxidizing agent and a flow of fuel are injected into a furnace, in which the oxidizing agent and the fuel react with one another to produce a flame capable of heating a charge, wherein the flow of oxidizing agent and/or the flow of fuel is or are injected in a pulsed manner using the pulsing valve according to claim 2.

11. Method for pulsing oxidizing gas and/or fuel, comprising introducing the gas and/or fuel to the valve according to claim 2.

12. Method according to claim 11, wherein a first control signal moves the moving part of the actuator in a direction which moves the valve shutter element closer to the valve seat, compressing the compressible member.

13. Method according to claim 12, wherein a second control signal cancels the force applied to the moving part of the actuator and releases the compressible member.

14. Method according to claim 12, wherein a third control signal applies to the moving part of the actuator a force which is in the opposite direction to the force created by the first control signal by means of which the compressible member is released more quickly.

15. Valve according to claim 1, wherein the second rigid means of connection connect the second end of the compressible member to the moving part of the actuator.

16. Valve according to claim 15, wherein the stop is adjustable in terms of position with respect to the valve body in the direction of travel.

17. Valve according to claim 15, wherein the compressible member comprises a part made of an elastomeric material with two parallel faces orthogonal to the direction of travel.

18. Valve according to claim 15, wherein the compressible member comprises a mechanical spring, the compression axis of which lies in the direction of compression.

19. Valve according to claim 15, wherein the valve seat comprises a frustoconical surface widening towards the inlet chamber, and the cone angle of which is at least equal to 90 degrees.

20. Valve according to claim 15, wherein the valve shutter element has a first face facing towards the valve seat which is substantially flat and a second face away from the valve seat which has the shape of a cone frustum widening towards the outlet chamber.

21. Valve according to claim 15, wherein the valve body comprises two separate parts comprising the inlet chamber and the outlet chamber respectively, and in that the seat is machined in a plate, the periphery of which is secured to the two parts that form the valve body and in that the shutter element is secured to the first rigid connection means by removable means.

22. Method of combustion in which a flow of oxidizing agent and a flow of fuel are injected into a furnace, in which the oxidizing agent and the fuel react with one another to produce a flame capable of heating a charge, wherein the flow of oxidizing agent and/or the flow of fuel is or are injected in a pulsed manner using the pulsing valve according to claim 15.

23. Method for pulsing oxidizing gas and/or fuel, comprising introducing the gas and/or fuel to the valve according to claim 15.

24. Method according to claim 23, wherein a first control signal moves the moving part of the actuator in a direction which moves the valve shutter element away from the valve seat, compressing the compressible member.

25. Method according to claim 24, wherein a second control signal cancels the force applied to the moving part of the actuator and releases the compressible member.

26. Method according to claim 24, wherein a third control signal applies to the moving part of the actuator a force which is in the opposite direction to the force created by the first control signal by means of which the compressible member is released more quickly.

27. Valve according to claim 15, wherein it further comprises an additional stop which is adjustable in terms of position with respect to the valve body in the direction of travel so as to limit the travel of the valve shutter element under the effect of the decompression of the compressible member.

28. Valve according to claim 1, wherein the stop is adjustable in terms of position with respect to the valve body in the direction of travel.

29. Valve according to claim 28, further comprising a fluid inlet pipe and a fluid outlet pipe opening laterally into the valve body into the inlet and outlet chambers respectively, and in that the mechanical stop or stops are arranged at the ends of the valve body in the direction of travel.

30. Valve according to claim 1, further comprising an additional stop which is adjustable in terms of position with respect to the valve body in the direction of travel so as to limit the travel of the valve shutter element under the effect of the decompression of the compressible member.

31. Valve according to claim 30, wherein it further comprises a fluid inlet pipe and a fluid outlet pipe opening laterally into the valve body into the inlet and outlet chambers respectively, and in that the mechanical stop or stops are arranged at the ends of the valve body in the direction of travel.

32. Valve according to claim 1, wherein the compressible member comprises a part made of an elastomeric material with two parallel faces orthogonal to the direction of travel.

33. Valve according to claim 1, wherein the compressible member comprises a mechanical spring, the compression axis of which lies in the direction of compression.

34. Valve according to claim 1, wherein the valve seat comprises a frustoconical surface widening towards the inlet chamber, and the cone angle of which is at least equal to 90 degrees.

35. Valve according to claim 1, wherein the valve shutter element has a first face facing towards the valve seat which is substantially flat and a second face away from the valve seat which has the shape of a cone frustum widening towards the outlet chamber.

36. Valve according to claim 1, wherein the valve body comprises two separate parts comprising the inlet chamber and the outlet chamber respectively, and in that the seat is machined in a plate, the periphery of which is secured to the two parts that form the valve body and in that the shutter element is secured to the first rigid connection means by removable means.

37. Method of combustion in which a flow of oxidizing agent and a flow of fuel are injected into a furnace, in which the oxidizing agent and the fuel react with one another to produce a flame capable of heating a charge, wherein the flow of oxidizing agent and/or the flow of fuel is or are injected in a pulsed manner using the pulsing valve according to claim 1.

38. Method according to claim 37, wherein at least one pulsing valve is used to inject the fuel and at least one pulsing valve is used to inject the oxidizing agent and in that the pulsations are identical in terms of direction but in phase opposition.

39. Method according to claim 38, in which there are at least two separate injections of the oxidizing agent, using identical or different oxidizing agents chosen from oxygen, substantially pure oxygen, oxygen-enriched air, air or oxygen-impoverished air, at least one of the two injections being carried out using the pulsing valve.

40. Method according to claim 37, wherein at least one pulsing valve is used to inject the fuel and at least one pulsing valve is used to inject the oxidizing agent, and wherein the pulsations are in phase.

41. Method according to claim 40, in which there are at least two separate injections of the oxidizing agent, using identical or different oxidizing agents chosen from oxygen, substantially pure oxygen, oxygen-enriched air, air or oxygen-impoverished air, at least one of the two injections being carried out using the pulsing valve.

42. Method according to claim 37, in which there are at least two separate injections of the oxidizing agent, using identical or different oxidizing agents chosen from oxygen, substantially pure oxygen, oxygen-enriched air, air or oxygen-impoverished air, at least one of the two injections being carried out using the pulsing valve.

43. Method for pulsing oxidizing gas and/or fuel, comprising introducing the gas and/or fuel to the valve according to claim 1.

* * * * *